United States Patent [19]

Storlie

[11] Patent Number: 4,768,432

[45] Date of Patent: Sep. 6, 1988

[54] OFFICE PAPER SHREDDER AND COMPACTOR

[75] Inventor: Lew Storlie, Decorah, Iowa

[73] Assignee: Deco Products Company

[21] Appl. No.: 898,445

[22] Filed: Aug. 19, 1986

[51] Int. Cl.[4] ..... B30B 3/04; B30B 15/08

[52] U.S. Cl. ..... 100/89; 100/97; 100/914

[58] Field of Search ..... 100/39, 82, 83, 89, 100/94, 97, 914

[56] References Cited

U.S. PATENT DOCUMENTS

| | | | |
|---|---|---|---|
| 639,436 | 12/1899 | Roberts | 100/97 |
| 960,027 | 5/1910 | Low | 100/97 X |
| 2,649,371 | 8/1953 | Reid | 162/261 |
| 2,686,466 | 8/1954 | Lee | 100/97 |
| 2,691,338 | 10/1954 | Robbins | 100/97 |
| 3,111,248 | 11/1963 | Pierson | 225/93 |
| 3,189,286 | 6/1965 | O'Connor | 100/97 X |
| 3,192,853 | 7/1965 | O'Connor | 100/39 |
| 3,316,694 | 5/1967 | McColly et al. | 100/94 X |
| 3,447,446 | 6/1969 | Dwyer | 100/39 X |
| 3,452,393 | 7/1969 | Pierson et al. | 100/907 X |
| 3,550,527 | 12/1970 | Sinitsin et al. | 100/97 |
| 3,636,864 | 1/1972 | Loscialo | 100/97 X |
| 3,682,402 | 8/1972 | Goldhammer | 241/100 |
| 3,736,221 | 5/1973 | Evers et al. | 523/319 |
| 3,752,063 | 8/1973 | Golde | 100/97 |
| 3,754,498 | 8/1973 | Gil | 100/97 X |
| 3,882,770 | 5/1975 | Bleasdale | 100/97 X |
| 3,986,845 | 10/1976 | Hotchkiss | 100/94 X |
| 4,060,363 | 11/1977 | Nelson | 100/97 X |

*Primary Examiner*—Wm. Carter Reynolds

*Attorney, Agent, or Firm*—Merchant, Gould, Smith, Edell, Welter & Schmidt

[57] ABSTRACT

An apparatus for shredding paper and the like and compacting the paper into a disposable cylindrical roll. The apparatus includes a pair of cooperating roller cutters mounted in a housing to cut the paper into elongate strips. The paper is compacted into cylindrical rolls by rotatably driven cylinder end wheels and a plurality of compacting rollers disposed about the circumference of the drum. The compacting rollers are rotatably driven in a direction opposite that of the end wheel. The compacted cylindrical roll is formed in a compacting zone defined by the rollers and end wheels. The apparatus can also compact paper without shredding. To allow for this function the housing has a paper feed opening that bypasses the roller cutters introducing the paper directly to the compacting zone.

5 Claims, 4 Drawing Sheets

OFFICE PAPER SHREDDER AND COMPACTOR

BACKGROUND OF THE INVENTION

1. Field of the Invention

On a daily basis, practically every business entity generates documents containing proprietary and confidential business information. Waste disposal of such documents through conventional means, such as simply throwing the documents in waste baskets, is undesireable, and indeed is not a good business practice. Competitors have been known to search through the waste discarded by their rivals in an unsophisticated form of industrial espionage. Other companies have obligations to their customers and clients to treat certain information in confidence. Again, the conventional means of disposal of documents containing such information is unsatisfactory.

Paper shredders are commercially available and are designed to meet the need for confidential document disposal. The function of the shredders is to tear the confidential documents into unrecognizable pieces, the disposal of which is then accomplished in conventional fashion. However, the mass of shredded paper thus produced is bulky and difficult to handle. Services are available that will contract to perform both the shredding and disposal functions. These services can be quite expensive.

2. Description of the Related Art

In an effort to deal with these various problems, machines which perform the dual functions of document destruction and compacting have been developed. Such apparatus is disclosed, for example, in U.S. Pat. Nos. 3,882,770, 3,754,498, 3,752,063 and 2,691,338. These devices include a cutting means to shred the paper. After the paper has been shredded, a device comprising a ram is actuated to compact the shredded waste into disposable bales. Since the shredding and baling operations are sequential, the overall waste processing time is extended.

SUMMARY OF THE INVENTION

The present invention is a paper shredding and compacting machine for destroying documents and compressing the generated waste into easily disposable cylinders. Shredding and compressing occur essentially simultaneously. The present invention also provides the alternative function of simply compacting paper waste. This function may be used to compact the waste paper when it is considered unnecessary to also shred the paper as, for example, in disposal of documents which do not contain confidential information.

The apparatus of the present invention incorporates a pair of cooperating cutter rollers mounted in a machine housing. The cutter rollers slice documents into elongate strips. The compacting function is accomplished by rotatably driven cylinder end wheels and associated compacting rollers, belts or chains that define a generally cylindrical compacting zone. A pair of cooperating feed rollers grasp the elongate strips as they are ejected from the cutting rollers and feed them into the compacting zone. The cooperating rotating action of the end wheels and rollers press the waste into cylindrical rolls. The feed rollers may be driven at a rate faster than the rotation rate of the cutters, whereby the feed rollers act to pull apart the elongate strips as they are ejected from the cutter rollers. The apparatus housing is also provided with a feed opening through which non-confidential documents can be inserted to the feed roller mechanism. These documents undergo the same type of compacting and compression as the shredded paper.

The present invention has the advantage of continuous and simultaneous shredding and compacting. Further, the waste is compacted into cylindrical rolls that can be easily disposed. These and other advantages of the invention will become apparent with reference to the accompanying drawings, detailed description of the invention and the claims.

DETAILED DESCRIPTION OF THE INVENTION

Figure 1:
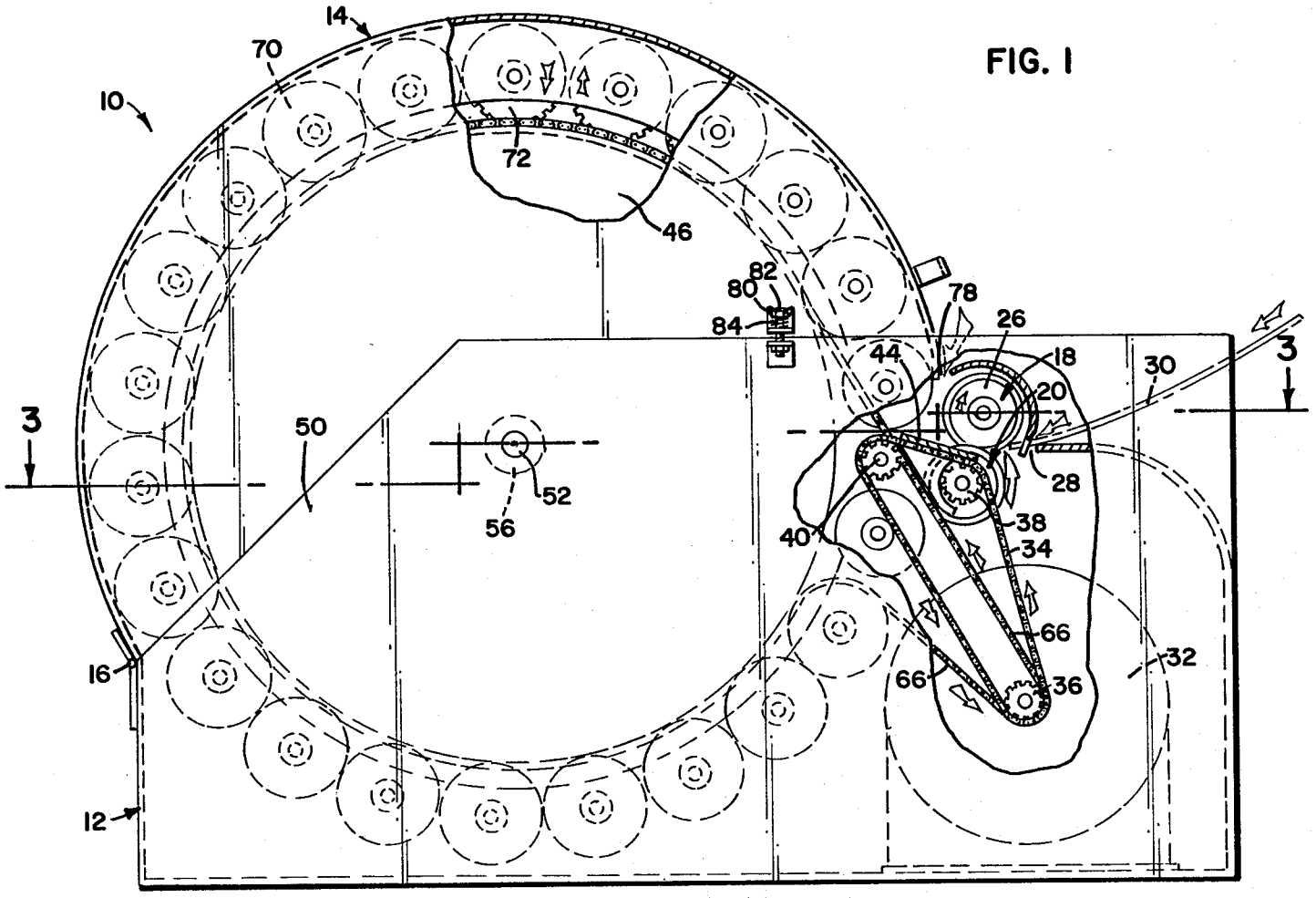
FIG. 1 is a side elevational view of the preferred embodiment of the invention with portions of the sidewalls cut-away to show interior structure.
Figure 2:
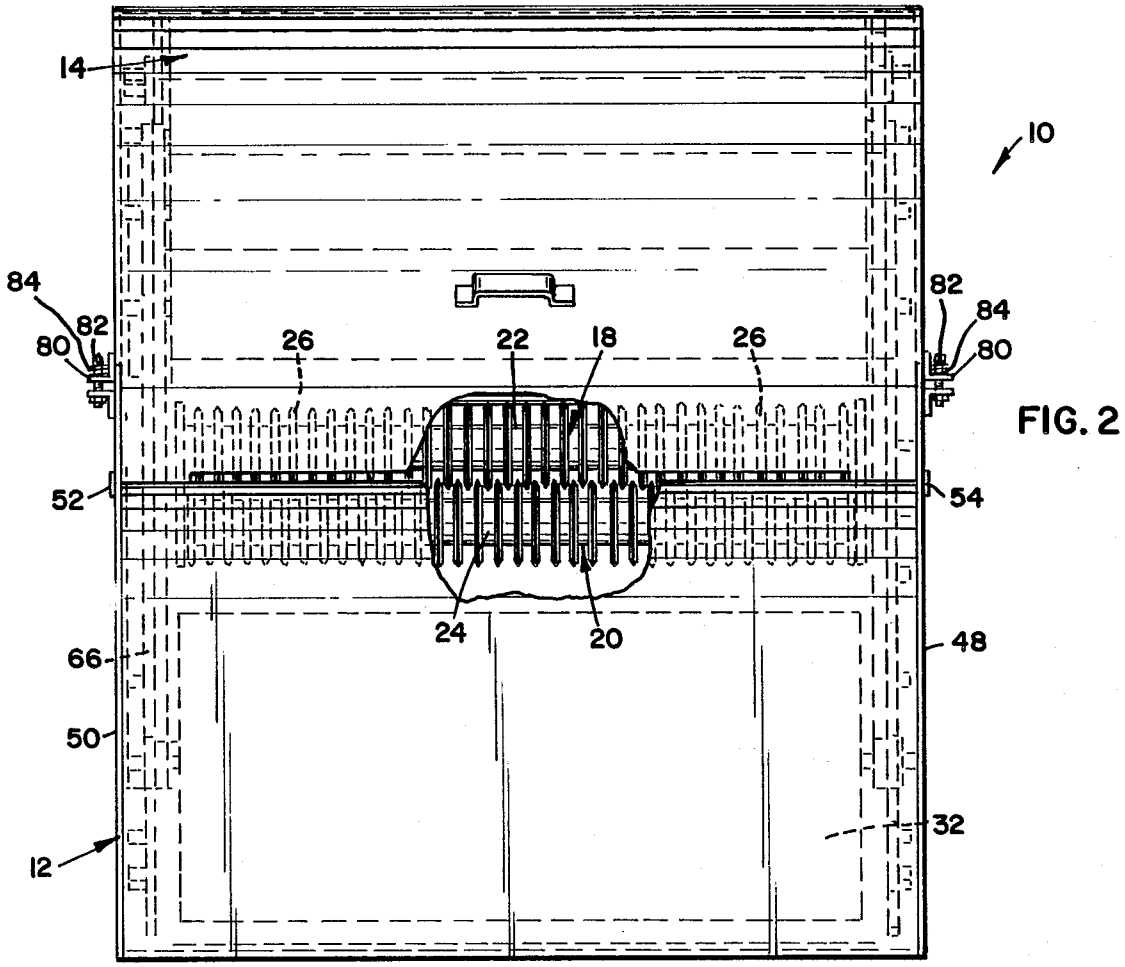
FIG. 2 is a front elevational view with portions cutaway to show the shredding means.

Referring to the drawings, the paper shredder and compacting apparatus of the present invention is designated generally as 10. Apparatus 10 includes a lower housing 12 and an upper housing 14. Upper housing 14 is hinged to lower housing 12 at 16. A pair of cooperating roller cutters 18, 20 are mounted within lower housing 12. Each roller cutter has a spindle or shaft 22, 24, respectively, to which is mounted a plurality of disc-like cutting blades 26. Cutting blades 26 on one shaft are interleaved with cutting blades 26 on the other shaft. Lower housing 12 has a first opening 28 into which documents, indicated as 30, are inserted for shredding. Roller cutters 18, 20 are rotatably driven in opposite directions to grasp and draw documents 30 into and between cutters 18, 20. In the embodiment illustrated, cutter 18 is rotatably driven in a clockwise direction, while roller cutter 20 is driven in a counter-clockwise direction.

Figure 4:
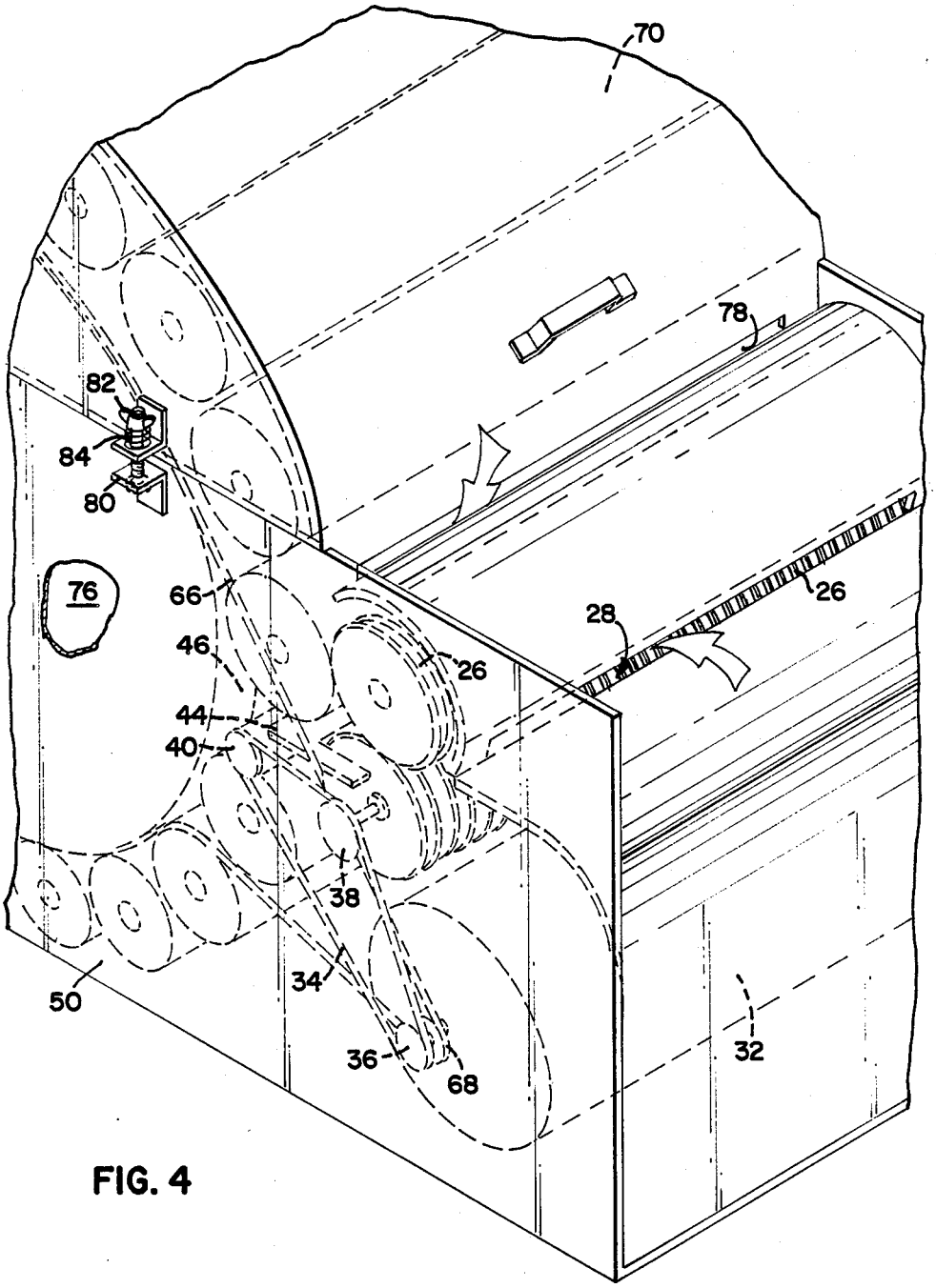
FIG. 4 is a fragmentary view in perspective of the preferred embodiment.

The drive means for the roller cutters includes drive motor 32 disposed within lower housing 12. In the embodiment illustrated herein, motor 32 drives at least roller cutter 20 and as will be described later, the end wheels and cooperating rollers, through a series of chains and sprockets. Other similar drive means such as belts could also be used. As shown in more detail in FIG. 4, roller cutter 20 is driven in a counter-clockwise direction by a drive chain 34 which is mounted about drive sprocket 36 and driven sprockets 38, 40. Roller cutter 18 may be free wheeling and as such would tend to be rotatably driven in the clockwise direction by the force imparted by cutter 20 through the engagement of cutters 18 and 20 with documents 30.

Alternatively, a gear arrangement, the structure of which would be well known to one of ordinary skill, would be provided to drive cutter 18 in the clockwise direction by drive chain 34.

Disposed adjacent the roller cutters 18, 20 is a feed plate 44 which serves to direct paper, either shredded or unshredded, into the compacting apparatus. Feed plate 44 extends across substantially the entire length of the cooperating cutter rollers 18, 20.

The compacting apparatus includes cylinder end wheels 46 and 47 rotatably mounted to housing 12 about a generally horizontal axis. As shown in more detail in FIG. 3, end wheels 46 and 47 may be mounted to sidewalls 48, 50 of lower housing 12 by any suitable shaft and bearing means. In the embodiment shown in FIG. 3, the mounting means comprises shafts 52, 54 journaled in flush mounted bearings 56, 58 and 60, 62, respectively, bearings 58 and 62 are mounted to end wheels 46 and 47, respectively. Drive chain 66 engages with drive sprocket 68 of drive motor 32 and is in frictional engagement with the outer surface of end wheel 46 to rotatably drive end wheel 46 in a counter clockwise direction. End wheel 47 freely rotates on its shaft 54.

Disposed about the circumference of end wheels 46 and 47 are a plurality of cylindrical rollers 70 which function to compress and compact waste paper into cylindrical rolls. As shown in FIG. 1, a portion of the rollers 70 are rotatably mounted in upper housing 14, while the remainder are rotatably mounted within lower housing 12. Rollers 70 are rotatably driven by drive chain 66. In the view illustrated in FIG. 1, rollers 70 are driven in a clockwise direction. Rollers 70 are provided with driven sprockets 72 which engage with drive chain 66. A compacting means that comprises a continuous belt or chain structure in lieu of rollers 70 is contemplated to be within the scope of the present invention.

A pinch roller 74 is disposed adjacent feed plate 44 to cooperate with one of rollers 70 to grasp the strips of shredded paper or the unshredded waste paper and feed it into the compacting zone 76 defined by end wheels 46 and 47 and rollers 70. Pinch roller 74 has a driven sprocket 40 that is engaged and driven by chain 34. Pinch roller 74 is preferably provided with a somewhat resilient or compressible surface, such as hard rubber, and is adjustably mounted by any convenient method considered to be within the skill of the art so that the relative pressure between pinch roller 74 and its cooperating roller 70 can be varied.

Apparatus 10 has an opening at 78 where upper housing 14 meets lower housing 12. This opening is for the insertion of waste paper when the user does not wish to shred the paper before it is compacted. Upper housing 14 is secured to lower housing 12 by a latch mechanism 80. Latch mechanism 80 may comprise any convenient, known device for securing upper housing 14 to lower housing 12 to maintain compacting pressure of rollers 70 in upper housing 14 against the waste being compressed and end wheels 46 and 47. In the preferred embodiment mechanism 80 comprises a thumbscrew 82 and spring 84 whereby the latching force may be adjusted.

Figure 3:
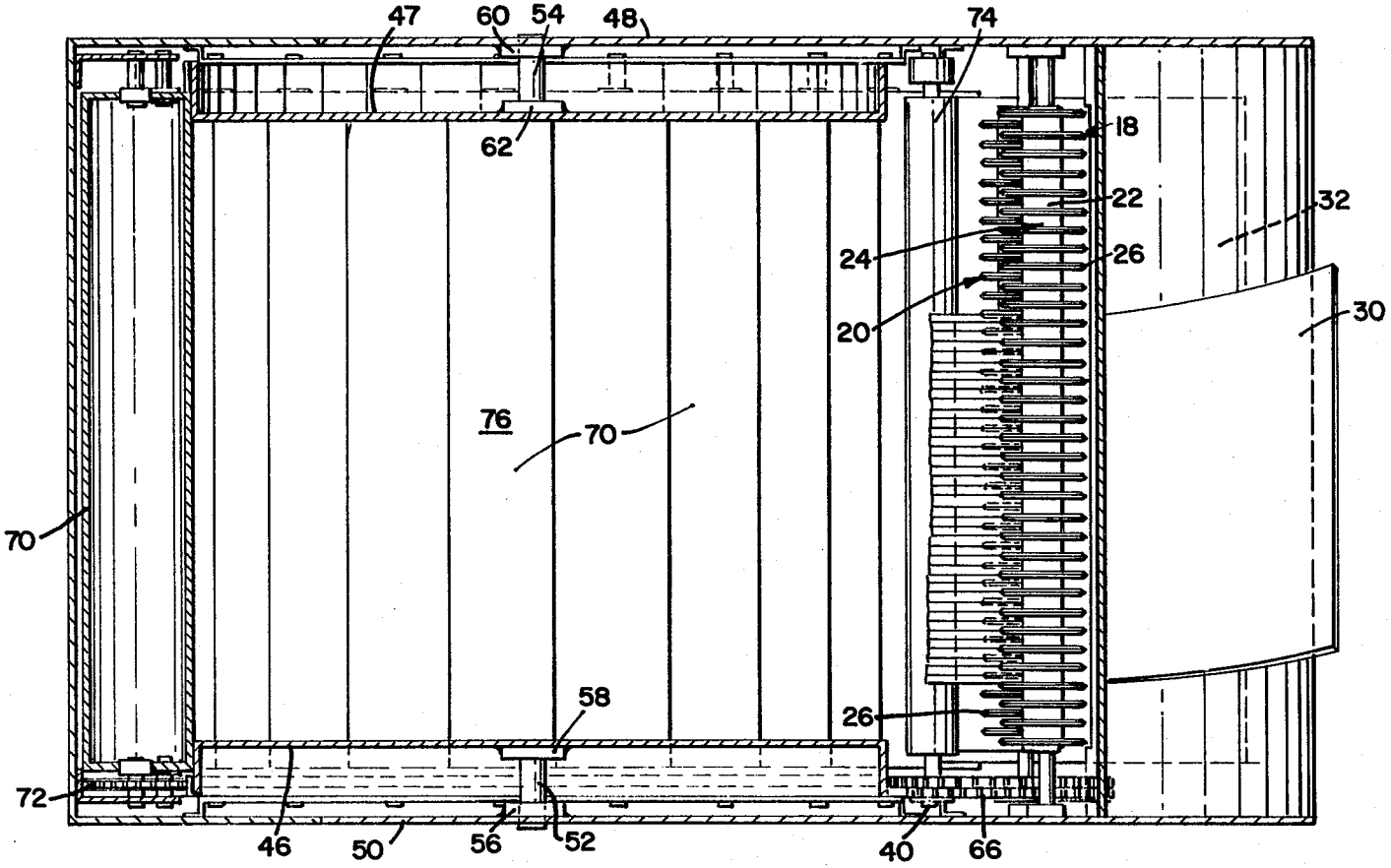
FIG. 3 is a plan view taken along line 3—3 of FIG. 1.

In operation, apparatus 10 functions as follows. In the case of paper to be shredded, documents 30 are inserted through opening 28 and roller cutters 18, 20 slice the paper into elongate strips, as shown in FIG. 3. The elongate strips are fed to cooperating pinch roller 74 and associated roller 70. Pinch roller 74 is driven at a faster rotational rate of speed than roller cutters 18, 20. Accordingly, pinch roller 74 and cooperating roller 70 tend to tear the elongate strips along tear lines generally normal to the axis of elongation of the strips which corresponds to the direction of feed of document 30 through apparatus 10. Pinch roller 74 and its cooperating feed roller 70 discharge the shredded paper into compacting zone 76. As the shredded paper begins to accumulate in zone 76, rollers 70 will start to compress and compact the waste. The paper will eventually be compacted into a cylindrical roll filling zone 76. As the accumulation of waste paper builds within apparatus 10, it is apparent that there will be increased forces between the compacted waste and rollers 70. Conventional prior art switching means could be provided to detect this increased force caused by accumulation of waste within apparatus 10 and to either automatically stop the machine and/or provide a visual or audible signal to the operator indicating that the machine is at its capacity. Removal of the compacted cylindrical roll is accomplished by releasing latch mechanisms 80 and pivoting upper housing 14 about the hinge point 16.

In some instances, one may wish to compact waste paper without first shredding it. Such paper may be inserted through opening 78 where it is guided by feed plate 44 into engagement with pinch roller 74 and its cooperating roller 70. This unshredded waste paper is then discharged into compacting zone 76 where it is compressed into a cylindrical rolls in the same manner as previously described. This unshredded paper may also be used to encompass the shredded cylinder for binding. Materials such as plastic wrap or string may also be fed in as a binder for the waste cylinder prior to its removal. A manual override switch may be provided to allow the operator to bind the cylinder after any automatic shut-off switch has been triggered.

What is claimed is:

1. Apparatus for shredding and compacting paper and the like comprising:

(a) a housing;

(b) a pair of cooperating cutter rollers rotatably mounted in said housing and adapted to cut the paper into elongate strips;

(c) a pair of cylinder end wheels rotatably mounted in the housing;

(d) a plurality of compacting rollers disposed about said end wheels and rotatably mounted within the housing about axes parallel to the rotatable axis of said end wheels, said compacting rollers cooperating with said end wheels to form cylindrical rolls of compacted paper from said elongate strips;

(e) means for rotatably driving said cutter rollers, at least one of said end wheels, and compacting rollers.

2. Apparatus in accordance with claim 1 further comprising means for tearing said elongate strips along tear lines generally perpendicular to the elongation axes of said strips.

3. Apparatus in accordance with claim 2 wherein said tearing means comprises a pair of compacting rollers disposed to receive said elongate strips from said cutter rollers.

4. Apparatus in accordance with claim 3 wherein at least one of said pair of tear rollers is rotatably driven at a rate faster than the rotational speed of said cutter rollers.

5. Apparatus in accordance with claim 4 wherein said housing has a first opening for insertion of paper or the like to be shredded, said first opening disposed proximate the rotational cutter rollers; and a second opening for insertion of paper or other material to be compacted only, or for material to be used as a binding for the compacted waste.

* * * * *